US009637704B2

(12) United States Patent
Yao et al.

(10) Patent No.: US 9,637,704 B2
(45) Date of Patent: May 2, 2017

(54) POLYALKYLENE GLYCOL-BASED INDUSTRIAL LUBRICANT COMPOSITIONS

(71) Applicant: VANDERBILT CHEMICALS, LLC, Norwalk, CT (US)

(72) Inventors: Junbing Yao, Bejing (CN); Steven G. Donnelly, Bethel, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 14/613,703

(22) Filed: Feb. 4, 2015

(65) Prior Publication Data

US 2016/0083671 A1 Mar. 24, 2016

Related U.S. Application Data

(60) Provisional application No. 62/052,725, filed on Sep. 19, 2014.

(51) Int. Cl.
*C10M 169/04* (2006.01)

(52) U.S. Cl.
CPC .. *C10M 169/04* (2013.01); *C10M 2209/1033* (2013.01); *C10M 2215/064* (2013.01); *C10M 2215/065* (2013.01); *C10M 2215/221* (2013.01); *C10N 2230/10* (2013.01); *C10N 2230/40* (2013.01); *C10N 2240/04* (2013.01); *C10N 2240/08* (2013.01); *C10N 2240/10* (2013.01); *C10N 2240/12* (2013.01); *C10N 2240/14* (2013.01); *C10N 2240/30* (2013.01); *C10N 2240/40* (2013.01); *C10N 2250/10* (2013.01)

(58) Field of Classification Search
CPC ..... C10M 169/04
See application file for complete search history.

(56) References Cited

U.S. PATENT DOCUMENTS

| | | | | |
|---|---|---|---|---|
| 4,904,401 | A | 2/1990 | Ripple et al. | |
| 4,957,649 | A | 9/1990 | Ripple et al. | |
| 5,840,672 | A | 11/1998 | Gatto | |
| 6,114,288 | A | 9/2000 | Fujitsu et al. | |
| 6,426,324 | B1 | 7/2002 | Lai et al. | |
| 6,726,855 | B1 * | 4/2004 | Migdal | C10M 161/00 252/401 |
| 8,592,357 | B2 | 11/2013 | Thoen et al. | |
| 2011/0039739 | A1 | 2/2011 | Greaves et al. | |
| 2012/0108482 | A1 | 5/2012 | Greaves et al. | |

FOREIGN PATENT DOCUMENTS

| | | | |
|---|---|---|---|
| GB | 1046353 | A | 10/1966 |
| WO | 2013/066702 | A2 | 5/2013 |

* cited by examiner

*Primary Examiner* — Taiwo Oladapo
(74) *Attorney, Agent, or Firm* — Norris McLaughlin & Marcus P.A.

(57) ABSTRACT

A lubricant composition comprises as a lubricant base, an oil soluble polyalkylene glycol suitable for use as a lubricant in an industrial oil, grease or metal working fluid; and an additive comprising (1) alkylated phenyl-α-naphthylamine; and (2) 2,2,4-trialkyl-1,2-dihydroquinoline.

7 Claims, No Drawings

POLYALKYLENE GLYCOL-BASED INDUSTRIAL LUBRICANT COMPOSITIONS

DESCRIPTION OF INVENTION

Field of the Invention

The invention relates to an antioxidant system for polyalkylene glycol based fluids used to develop automobile engine oil, industrial air compressor fluids, industrial hydraulic fluids, fire-resistant hydraulic fluids, metalworking fluids, greases, turbine oils and gear lubricants.

Background of the Invention

Industrial lubricants provide a critical role in the global economy. In recent years the performance demands on a wide variety of industrial lubricants have increased. For example, modern hydraulics operate at higher pressures and temperatures while possessing smaller reservoir sizes, tighter clearances and finer filter pores. Modern combined cycle gas turbines run at much higher temperatures and their lubricating systems are prone to varnish and sludge formation requiring significant cost and time for maintenance. While conventional lubricants have been sufficient in the past for protecting critical machinery and managing maintenance costs, in many cases these same lubricants are inadequate for today's technologically advanced machinery. Synthetic lubricants such as severely refined mineral (Group III) oils, poly-alpha-olefins, synthetic esters and poly-alkylene glycols offer performance advantages over conventional lubricants. Depending on the synthetic lubricant type, advantages may include improved additive solubility, improved oxidative stability, improved deposit control, improved energy efficiency and reduced system wear. Oil soluble polyalkylene glycols are a new class of synthetic lubricant that provides many of these advantages. In order to fully capitalize on the benefits of oil soluble polyalkylene glycols, the fluids require a very high level of oxidation stability.

It is noted that synthetic esters of all types suffer from poor hydrolytic stability due to the ester-based functionality as part of the chemical composition of these fluids. Therefore, it is preferable to use oil soluble polyalkylene glycols, because they do not possess a hydrolytically sensitive functional group, and therefore are not prone to hydrolysis or undesirable reactions with water.

U.S. Pat. No. 6,726,855 teaches a synthetic ester composition comprising a secondary arylamine antioxidant, such as alkylated diphenylamines, and a 2,2,4-trialkyl-1,2-dihydroquinoline or polymer thereof. While the patent contemplates a long list of possible arylamines, such as phenyl-α-naphthylamines, it does not consider alkylated phenyl-α-naphthylamines in particular.

U. S. Patent Application 2011/0039739 teaches a lubricant comprising a polyalkylene glycol, a polyol ester, an alkylated diphenylamine antioxidant such as alkylated phenyl-α-naphthylamines, a phosphorus-based EP additive, a yellow metal passivator and a corrosion inhibitor U.S. Pat. No. 8,592,357 teaches a lubricant composition comprising polyalkylene glycol suitable for use in automotive engines, and an additive package comprising an acid scavenger, as well as alkylated phenyl-α-naphthylamines.

Great Britain Patent 1046353 teaches a composition comprising a synthetic lubricant and a diarylamine antioxidant.

U.S. Patent Application 2012/0108482 teaches a lubricant composition comprising a Group I, II, III or IV hydrocarbon oil and a polyalkylene glycol, the polyalkylene glycol having been prepared by reacting a C8-C20 alcohol and a mixed butylene oxide/propylene oxide feed, wherein the ratio of butylene oxide to propylene oxide ranges from 3:1 to 1:3, the hydrocarbon oil and the polyalkylene glycol being soluble with one another.

WO 2013066702 teaches a lubricant composition comprising at least 90 wt % of at least one oil soluble polyalkylene glycol (OSP), wherein the OSP comprises at least 40 wt % units derived from butylene oxide and at least 40 wt % units derived from propylene oxide, initiated by one or more initiators selected from monols, diols and polyols; and at least 0.05 wt % of at least one anti-wear additive; wherein the lubricant composition exhibits a four ball anti-wear of less than or equal to 0.35 mm and an air release value at 50° C. of less than or equal to 1 minute.

U.S. Pat. No. 6,426,324 teaches a reaction product of alkylated PANA and alkylated diphenylamine in the presence of a peroxide free radical source and an ester solvent.

SUMMARY OF THE INVENTION

In utilizing polyalkylene glycol bases, however, it has been found that known oxidation inhibitors which are particularly useful in other commercial base oils, such as alkylated phenyl-α-naphthylamine or 2,2,4-trialkyl-1,2-dihydroquinoline, when used individually, provide poor oxidation protection. Therefore, there would be a bias against using these additives as antioxidants in a PAG base. It was quite surprising therefore, to observe that while these additives in their individual capacities are poor antioxidants in PAG base oils, the use of these two additives in combination in a PAG base oil provides an unexpected and marked improvement against oxidation, even surpassing the protection provided in other base oil types. This invention provides a powerful antioxidant system capable of delivering superior oxidation protection to the oil soluble polyalkylene glycols.

The main technical challenge was to develop an antioxidant system that was effective for improving the oxidation performance of oil soluble polyalkylene glycols in the two critical industry bench tests that are commonly used for preliminary screening of antioxidants. These are the PDSC (ASTM D 6186) and the RPVOT (ASTM D 2272). From preliminary work it was discovered that some antioxidants, or antioxidant combinations, performed well in one test, but not both tests. For example, the polymerized 1,2-dihydro-2,2,4-trimethylquinoline, available as Vanlube® RD from Vanderbilt Chemicals, LLC of Norwalk, Conn., performed exceptionally well in the RPVOT, but performed very poorly in the PDSC. However, the combination of octylated phenyl-α-naphthylamine and Vanlube® RD additive was shown to perform exceptionally well in both the PDSC and RPVOT

DETAILED DESCRIPTION OF THE INVENTION

Accordingly, the invention relates to a lubricant composition comprising as a lubricant base, an oil soluble polyalkylene glycol suitable for use as a lubricant in an industrial oil, grease or metal working fluid; and an additive comprising (1) alkylated phenyl-α-naphthylamine; and (2) 2,2,4-trialkyl-1,2-dihydroquinoline or a polymer thereof of the structure:

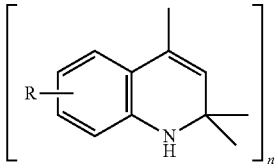

where n=1-1000 and R is hydrogen, alkyl, or alkoxy; preferably wherein the composition is substantially free of synthetic ester based lubricating oils.

More particularly, the polyalkylene glycol comprises a random or block copolymer polyalkylene glycol based on ethylene oxide and propylene oxide, wherein at least 30% by weight of the polyalkylene glycol is ethylene oxide units. Even more particularly, the oil soluble polyalkylene glycol may be prepared by reacting a $C_8$-$C_{20}$ alcohol and a mixed butylene oxide/propylene oxide feed, wherein the weight ratio of butylene oxide to propylene oxide ranges from 3:1 to 1:3.

Examples of oil soluble polyalkylene glycols that may be used include: UCON™ OSP-18, UCON™ OSP-32, UCON™ OSP-46, UCON™ OSP-68, UCON™ OSP-150, UCON™ OSP-220, UCON™ OSP-320, UCON™ OSP-460 and UCON™ OSP-680 from Dow Chemical Company. The invention also includes the use of water-soluble and other PAG base oils, such as Emkarox® VG130W water-soluble PAG, Emkarox® VG380 water and oil insoluble PAG, and Emkarox® VG330W water-soluble PAG, available from Croda Lubricants.

Examples of alkylated phenyl-α-naphthylamines that may be used include: butylated phenyl-α-naphthylamine, octylated phenyl-α-naphthylamine, nonylated phenyl-α-naphthylamine, dodecylated phenyl-α-naphthylamine, $C_4$ to $C_{30}$ alkylated phenyl-α-naphthylamine, alkylated phenyl-α-naphthylamine prepared from phenyl-α-naphthylamine and diisobutylene, alkylated phenyl-α-naphthylamine prepared from phenyl-α-naphthylamine and propylene trimer, alkylated phenyl-α-naphthylamine prepared from phenyl-α-naphthylamine and propylene tetramer, and alkylated phenyl-α-naphthylamine prepared from phenyl-α-naphthylamine and oligomers of propylene or isobutylene. Preferred commercial examples of alkylated phenyl-α-naphthylamines that may be used include Vanlube® 1202 octylated phenyl-α-naphthylamine from Vanderbilt Chemicals, LLC, Irganox® L-06 octylated phenyl-α-naphthylamine from BASF Corporation and Naugalube® APAN $C_{12}$-alkylated phenyl-α-naphthylamine from Chemtura Corporation.

Commercial examples of Component (2) include Vanlube® RD polymerized 1,2-dihydro-2,2,4-trimethylquinoline and Vanlube® RD-HT aromatized 1,2-dihydro-2,2,4-trimethylquionoline polymer with predominantly 2 to 6 monomer units from Vanderbilt Chemicals, LLC, and Naugalube® TMQ, 1,2-Dihydro-2,2,4-trimethylquinoline, oligomers, from Chemtura Corporation.

A preferred lubricant composition of the invention comprises a polyalkylene glycol base, and an antioxidant additive comprising (1) alkylated phenyl-α-naphthylamine and (2) polymerized 1,2-dihydro-2,2,4-trimethylquinoline. An amount of additive in the composition may be from about 0.1-3%, preferably from about 0.25%-2%; wherein the ratio of component (1) to component (2) is from about 1:5 to 5:1, preferably about 1:3 to 3:1, and most preferably about 1:1.

The lubricant composition has a base comprising polyalkylene glycol in an amount of at least 20% by weight, preferably at least 50% by weight and more preferably at least 90% by weight. Other base oils known in the industry may be present (though one particular embodiment of the invention is free or substantially free of ester base oil and/or natural base oil and/or mineral oil and/or non-PAG synthetic base oil; and a further embodiment exists wherein the base oil consists of polyalkylene glycol). The lubricating oil may contain other additives including additional oxidation inhibitors, detergents, dispersants, viscosity index modifiers, rust inhibitors, anti-wear additives, and pour point depressants.

Oxidation Inhibitor Components

Additional oxidation inhibitors that may be used include alkylated diphenylamines (ADPAs) and hindered phenolics.

Alkylated diphenylamines are widely available antioxidants for lubricants. One possible embodiment of an alkylated diphenylamine for the invention are secondary alkylated diphenylamines such as those described in U.S. Pat. No. 5,840,672, which is hereby incorporated by reference. These secondary alkylated diphenylamines are described by the formula X—NH—Y, wherein X and Y each independently represent a substituted or unsubstituted phenyl group wherein the substituents for the phenyl group include alkyl groups having 1 to 20 carbon atoms, preferably 4-12 carbon atoms, alkylaryl groups, hydroxyl, carboxy and nitro groups and wherein at least one of the phenyl groups is substituted with an alkyl group of 1 to 20 carbon atoms, preferably 4-12 carbon atoms. It is also possible to use commercially available ADPAs including VANLUBE® SL (mixed alkylated diphenylamines), VANLUBE® DND (mixed nonylated diphenylamine), VANLUBE® NA (mixed alkylated diphenylamines), VANLUBE® 81 (p,p'-dioctyldiphenylamine) and VANLUBE® 961 (mixed octylated and butylated diphenylamines) manufactured by Vanderbilt Chemicals, LLC, Naugalube® 640, 680 and 438L manufactured by Chemtura Corporation, Irganox® L-57 and L-67 manufactured by BASF Corporation, and Lubrizol 5150A & C manufactured by Lubrizol Corporation. Another possible ADPA for use in the invention is a reaction product of N-phenyl-benzenamine and 2,4,4-trimethylpentene.

Hindered phenolics are also widely available antioxidants for lubricants. A preferred hindered phenol is available from Vanderbilt Chemicals, LLC as Vanlube® BHC (Iso-octyl-3-(3,5-di-tert-butyl-4-hydroxyphenyl) propionate). Other hindered phenols may include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-distyryl-4-nonylphenol, 4,4'-methylenebis(2,6-di-tert-butylphenol) and their analogs and homologs. Mixtures of two or more such phenolic compounds are also suitable.

Additional sulfur containing antioxidant such as, methylene bis (dibutyldithiocarbamate) and tolutriazole derivative may be used in the lubricating additive compositions. One such supplemental antioxidant component is commercially available under the trade name VANLUBE® 996E, manufactured by Vanderbilt Chemicals, LLC.

Viscosity Modifiers

Viscosity modifiers (VM) may be used in the lubricant to impart high and low temperature operability. VM may be used to impart that sole function or may be multifunctional. Multifunctional viscosity modifiers also provide additional functionality for dispersant function. Examples of viscosity modifiers and dispersant viscosity modifiers are polymethacrylates, polyacrylates, polyolefins, styrene-maleic ester copolymer and similar polymeric substances including homopolymers, copolymers and graft copolymers.

Base Oil Component

Base oils suitable for use in formulating the compositions, additives and concentrates described herein may be selected from any of the synthetic or natural oils or mixtures thereof. The synthetic base oils includes alkyl esters of dicarboxylic acids, poly-alpha olefins, including polybutenes, alkyl benzenes, organic esters of phosphoric acids, polysilicone oils and alkylene oxide polymers, interpolymers, copolymers and derivatives thereof where the terminal hydroxyl group have been modified by esterification, etherification and the like.

Natural base oil may include animal oils and vegetable oils (e.g. rapeseed oil, soy bean oil, coconut oil, castor oil, lard oil), liquid petroleum oils and hydro-refined, solvent treated or acid treated mineral lubricating oils of paraffinic, naphthenic and mixed paraffinic naphthenic types. Oils of lubricating viscosity derived from coal or shale are also useful base oils. The base oils typically have viscosity of about 2.5 to about 15 cSt and preferably about 2.5 to about 11 cSt at 100° C.

The base oil may be derived from unrefined, refined, rerefined oils, or mixtures thereof. Unrefined oils are predominantly obtained from a natural or synthetic source (e.g. coal, shale, tar sand) without further purification. Refined oils are similar to unrefined oils except that refined oils have been treated in one or more purification steps to improve the properties of the oil. Suitable purification steps include distillation, hydrocracking, hydrotreating, dewaxing, solvent extraction, acid or base extraction, filtration and percolation. Rerefined oils are obtained by treating used oils in a process similar to those used to obtain the refined oils. Rerefined oils are also known as reclaimed, reprocessed or recycled oils and are usually additionally processed by techniques for removal of spent additives and oil degradation products. Suitable base oils include those in all API categories I, II, III, IV and V.

Detergent Components

The lubricating composition may also include detergents. Detergents as used herein are preferably metal salts of organic acids. The organic portion of the detergent is preferably sulfonate, carboxylate, phenates, and salicylates. The metal portion of the detergent is preferably an alkali or alkaline earth metal. Preferred metals are sodium, calcium, potassium and magnesium. Preferably the detergents are overbased, meaning that there is a stoichiometric excess of metal over that needed to form neutral metal salts.

Dispersant Components

The lubricating composition may also include dispersants. Dispersants may include, but are not limited to, a soluble polymeric hydrocarbon backbone having functional groups capable of associating with particles to be dispersed. Typically, amide, amine, alcohol or ester moieties attached to the polymeric backbone via bridging groups. Dispersants may be selected from ashless succinimide dispersants, amine dispersants, Mannich dispersants, Koch dispersants and polyalkylene succinimide dispersants.

Antiwear Components

Zinc dialkyl dithiophosphates (ZDDPs) may also be used in the lubricating oil additive compositions. ZDDPs have good antiwear and antioxidant properties and have been used as wear protection for the critical components of engines. Many patents address the manufacture and use of ZDDPs including U.S. Pat. Nos. 4,904,401; 4,957,649, and 6,114,288. Non limiting general ZDDP types are primary and secondary ZDDPs, and mixtures of primary and secondary ZDDPs. Additional supplemental antiwear components may be used in the lubricating oil additive composition. This includes, but not limited to, borate esters, aliphatic amine phosphates, aromatic amine phosphates, triarylphosphates, ashless phosphorodithioates, ashless dithiocarbamates and metal dithiocarbamates.

Other Components

Rust inhibitors selected from the group consisting of metal sulfonate based such as calcium dinonyl naphthalene sulfonate, DMTD based rust inhibitors such as 2,5-Dimercapto-1,3,4-Thiadiazole Alkyl Polycarboxylate, derivatives of dodecenylsuccinic acid and fatty acid derivatives of 4,5-dihydro-1H-imidazole may be used.

Pour point depressants are particularly important to improve low temperature qualities of a lubricating oil. Pour point depressants contained in the additive composition may be selected from polymethacrylates, vinyl acetate or maleate copolymer, and styrene maleate copolymer. A comparison between this invention using oil soluble polyalkylene glycols and the closest prior art using synthetic esters is provided below. The example shows that when synthetic esters are employed the combination of alkylated PANA and 2,2,4-trialkyl-1,2-dihydroquinoline or a polymer thereof, shows a 22 to 37% synergistic effect. However, the same antioxidant combination in oil soluble polyalkylene glycols shows a 50 to 100% synergistic effect. PDSC Oxidation Test (ASTM D6168, 3.0 mg sample, 3.5 MPa pressure, 160 and 200° C.).

TABLE 1

PDSC oxidation induction time in ester base oil

| | | PDSC oxidation induction time, min, 200° C. | | |
|---|---|---|---|---|
| | Base oil: Pentaerythritol tetraester (NP451 from ExxonMobil Chemical) | 0 | | |
| 1 | +1.0% Vanlube 81 | 111.6 | | |
| 2 | +2.0% Vanlube 81 | 139.3 | | |
| 3 | +1.0% Vanlube 1202 | 96.3 | | |
| 4 | +2.0% Vanlube 1202 | 122.3 | | |
| 5 | +1.0% Naugalube APAN | 61.0 | | |
| 6 | +1.0% Vanlube RD | 161.0 | | |
| 7 | +2.0% Vanlube RD | 221.2 | | |
| | | Actual | Expected | Improved |
| 8 | +0.5% Vanlube RD + 0.5% Vanlube 81 | 151.7 | (136.3) | 11.3% |
| 9 | +1.0% Vanlube RD + 1.0% Vanlube 81 | 235.4 | (180.3) | 30.1% |
| 10 | +0.5% Vanlube RD + 0.5% Vanlube 1202 | 176.3 | (128.7) | 37.0% |
| 11 | +1.0% Vanlube RD + 1.0% Vanlube 1202 | 209.7 | (171.8) | 22.1% |
| 12 | +0.5% Vanlube RD + 0.5% Naugalube APAN | 140.0 | (111.0) | 26.1% |

TABLE 2

PDSC oxidation induction time in oil-soluble PAG base oil

| | | PDSC oxidation induction time, min, 160° C. | | |
|---|---|---|---|---|
| | Base Oil: Ucon OSP320 | 0 | | |
| 13 | +0.5% Vanlube RD | 11.2 | | |
| 14 | +1.0% Vanlube RD | 22.5 | | |
| 15 | +0.5% Vanlube 961 | 16.4 | | |
| 16 | +1.0% Vanlube 961 | 43.4 | | |
| 17 | +0.5% Naugalube APAN | 44.5 | | |
| 22 | +1.0% Naugalube APAN | 120.7 | | |
| 23 | +1.0% Irganox L06 | 135.3 | | |
| | | Actual | Expected | Improved |
| 24 | +0.25% Vanlube RD + 0.25% Vanlube 961 | 15.6 | (13.8) | 14.6% |

TABLE 2-continued

| PDSC oxidation induction time in oil-soluble PAG base oil | | | | |
|---|---|---|---|---|
| | | PDSC oxidation induction time, min, 160° C. | | |
| 25 | +0.5% Vanlube RD + 0.5% Vanlube 961 | 32.2 | (33.0) | −2.4% |
| 26 | +0.5% Vanlube RD + 0.5% Naugalube APAN | 143.0 | (71.6) | 99.7% |
| 27 | +0.25% Vanlube RD + 0.25% Naugalube APAN | 52.4 | (27.9) | 87.8% |
| 28 | +0.5% Vanlube RD + 0.5% Irganox L06 Base Oil: Ucon OSP46 | 155.4 | (78.9) | 97.0% |
| 28 | +0.5% Vanlube RD + 0.5% Irganox L06 Base Oil: Ucon OSP32 | 123.4 | | |
| 29 | +0.5% Vanlube RD + 0.5% Irganox L06 | 138.8 | | |

Vanlube® 81 is octylated diphenylamine; Vanlube® 961 is octylated and butylated diphenylamine.

In the above tables, the "Actual" induction time is the measured time, while "Expected" is the anticipated theoretical value based on an average of the induction time for the individual antioxidant components at the same total amount of AO additive. For example, Example 3 provides 1% of component (1) and Example 6 provides 1% of component (2), while Example 10 provides a total antioxidant additive at 1% as well, comprising a combination of (1) and (2). Thus, without a synergistic effect, it is expected that the induction time would be the average of the two AO components separately. In the case of Example 10, the expected induction time is 128.7 minutes, being an average of the times of Examples 3 and 6. However, as the actual measured induction time for Example 10 is 176 minutes, this demonstrates a synergistic "Improved" induction time as 37%.

Table 1 shows replicates the prior art composition of U.S. Pat. No. 6,726,855, which exemplifies an additive comprising Naugalube 640 (octylated, butylated diphenylamine; represented in Table 1 by Vanlube 81) and Naugalube TMQ (represented by Vanlube RD), in ester base oil. It can be seen that a synergistic increase of the antioxidant combination over the additive components alone is achieved, at about 11-30%.

Table 1 also shows test data in ester base oil for a combination based on the inventive combination of Vanlube RD 1,2-dihydro-2,2,4-trimethylquinoline (TMQ) with an alkylated phenyl-α-naphthylamine. This additive in the ester base oil also shows a modest synergy, in the range of about 22-37%, comparable to the TMQ/ADPA combination favored by U.S. Pat. No. 6,726,855.

In Table 2, applicant demonstrates that expectations from ester base oils cannot be transferred to PAG base oils. To begin with, the combination of TMQ/ADPA additive as taught by the prior art for ester oils is simply not effective in a PAG base oil (see examples 23, 24). However, with reference to examples 25 and 26, a remarkable synergy of an almost two-fold increase (87.8-99.7%) in antioxidant protection is shown for the novel combination of TMQ and alkylated PAN, when the antioxidant composition is used with a PAG base oil.

In view of the expectations of the prior art, it is quite unexpected that the combination of TMQ and APAN in a PAG base oil exhibits such a strong improvement, particularly when compared to the lack of synergy between the known combination of TMQ and ADPA. It is further surprising that, given the modest synergy shown between TMQ/ADPA (and even with TMQ/APAN) in ester base oils, that the behavior of these two additive combinations should behave so divergently when used with a PAG base oil.

It is noted that in certain examples, such as Table 3, no. 32, the Determined value for the additive combination is actually lower than the actual value of equivalent amount of additive being the APAN alone. However, in reviewing the entirety of the data, it is seen that APAN alone has a much more potent antioxidant effect than the trimethylquinoline. Nevertheless, given the fact that APAN is much more expensive than the trimethylquinoline, there would be a great commercial desire to be able to reduce the amount of APAN needed, while still achieving a comparable antioxidant protection. The data clearly show that, even though APAN alone may be superior to the combined additive in certain formulations, a surprising boost to the antioxidant effectiveness may be achieved by substituting an appropriate amount of the trimethylquinoline, which is greater than the expected impact of the quinoline alone (the 'expected' total value). Thus, the effect of the trimethylquinoline must be synergistic.

AO Experimental Data by PDSC for APANA/TMQ

TMQ is 1,2-dihydro-2,2,4-trimethylquinoline composed of dimer and trimer units, i.e., Vanlube° RD.

Vanlube® RD-HT is aromatized 1,2-dihydro-2,2,4-trimethylquinoline polymer with predominantly 2 to 6 monomer units. Vanlube® 1202 is a C8 alkylated PANA (solid), and Naugalube° APAN is a C12 alkylated PANA (liquid).

PDSC Oxidation Test (ASTM D6168, 3.0 mg sample, 3.5 MPa pressure, 160 and 180° C.).

TABLE 3

| PDSC oxidation induction time in Oil-soluble PAG base oil At low treat level of 0.25% | | | | |
|---|---|---|---|---|
| | | PDSC oxidation induction time, min, 160° C. | | |
| | Base Oil: Ucon OSP46 | 0 | | |
| 29 | +0.25% Vanlube 1202 | 27.9 | | |
| 30 | +0.25% Vanlube RD | 8.6 | | |
| | | Actual | Expected | Improved |
| 32 | +0.125% Vanlube 1202 + 0.125% Vanlube RD (1:1) | 25.3 | (18.3) | 38% |
| 33 | +0.063% Vanlube 1202 + 0.187% Vanlube RD (1:3) | 10.9 | (13.4) | −19% |
| 34 | +0.187% Vanlube 1202 + 0.063% Vanlube RD (3:1) | 37.0 | (23.1) | 60% |

Conclusion: For low treat level to 0.25%, when the ratio of Vanlube 202/RD is more than 1:1, they are AO synergistic, i.e., from the ratio of 1:1 to 3:1, with the strongest synergy at 3:1.

TABLE 4

| PDSC oxidation induction time in Oil-soluble PAG base oil At low treat level of 0.5% | | |
|---|---|---|
| | | PDSC oxidation induction time, min, 160° C. |
| | Base Oil: Ucon OSP320 | 0 |
| 35 | +0.5% Naugalube APAN | 44.5 |
| 36 | +0.5% Vanlube RD | 11.2 |

TABLE 4-continued

PDSC oxidation induction time in Oil-soluble PAG base oil
At low treat level of 0.5%

| | | PDSC oxidation induction time, min, 160° C. | | |
|---|---|---|---|---|
| | | Actual | Expected | Improved |
| 37 | +0.25% Naugalube APAN + 0.25% Vanlube RD (1:1) | 52.4 | (27.9) | 88% |
| 38 | +0.125% Naugalube APAN + 0.375% Vanlube RD (1:3) | 25.9 | (19.5) | 33% |
| 39 | +0.375% Naugalube APAN + 0.125% Vanlube RD (3:1) | 43.9 | (36.2) | 21% |

Conclusion: For low treat level to 0.5%, when Naugalube APAN and Vanlube RD are AO synergistic from the ratio of 1:3 to 3:1, with the strongest synergy at 1:1.

TABLE 5

PDSC oxidation induction time in Oil-soluble PAG base oil
At high treat level of 2.0%

| | | PDSC oxidation induction time, min, 200° C. | | |
|---|---|---|---|---|
| | Base Oil: Ucon OSP46 | 0 | | |
| 40 | +2.0% Vanlube 1202 | 52.9 | | |
| 41 | +2.0% Vanlube RD | 4.9 | | |
| | | Actual | Expected | Improved |
| 42 | +1.0% Vanlube 1202 + 1.0% Vanlube RD (1:1) | 45.4 | (28.9) | 57% |
| 43 | +0.5% Vanlube 1202 + 1.5% Vanlube RD (1:3) | 26.8 | (16.9) | 59% |
| 44 | +1.5% Vanlube 1202 + 0.5% Vanlube RD (3:1) | 42.0 | (40.9) | 3% |

Conclusion: For high treat level to 2.0%, Vanlube 1202 and RD are AO synergistic from the ratio of 1:3 to 3:1.

TABLE 6

PDSC oxidation induction time in Oil-soluble PAG base oil
At treat level of 1.0%

| | | PDSC oxidation induction time, min, 160° C. | | |
|---|---|---|---|---|
| | Base Oil: Ucon OSP46 | 0 | | |
| 45 | +1.0% Vanlube 1202 | 145.9 | | |
| 46 | +1.0% Vanlube RD-HT | 58.1 | | |
| | | Actual | Expected | Improved |
| 47 | +0.5% Vanlube 1202 + 0.5% Vanlube RD-HT (1:1) | 155.5 | (102.0) | 53% |
| 48 | +0.25% Vanlube 1202 + 0.75% Vanlube RD-HT (1:3) | 122.5 | (80.1) | 53% |
| 49 | +0.75% Vanlube 1202 + 0.25% Vanlube RD-HT (3:1) | 161.6 | (124.0) | 30% |

Conclusion: For the treat level of 1.0%, Vanlube 1202 and Vanlube RD-HT are AO synergistic from the ratio of 1:3 to 3:1.

TABLE 7

PDSC OIT in Group II base oil containing 20% Oil-soluble PAG base oil
At treat level of 1.0%

| | | PDSC oxidation induction time, min, 160° C. | | |
|---|---|---|---|---|
| | Base Oil: 150N: OSP46 = 4:1 | 0 | | |
| 50 | +1.0% Vanlube 1202 | 211.3 | | |

TABLE 7-continued

PDSC OIT in Group II base oil containing 20% Oil-soluble PAG base oil
At treat level of 1.0%

| | | PDSC oxidation induction time, min, 160° C. | | |
|---|---|---|---|---|
| 51 | +1.0% Vanlube RD | 33.1 | | |
| 52 | +1.0% Vanlube RD-HT | 120.6 | | |
| | | Actual | Expected | Improved |
| 53 | +0.5% Vanlube 1202 + 0.5% Vanlube RD (1:1) | 256.5 | (122.2) | 110% |
| 54 | +0.25% Vanlube 1202 + 0.75% Vanlube RD (1:3) | 120.2 | (77.7) | 55% |
| 55 | +0.75% Vanlube 1202 + 0.25% Vanlube RD (3:1) | 253.7 | (166.8) | 52% |
| 56 | +0.5% Vanlube 1202 + 0.5% Vanlube RD-HT (1:1) | 273.9 | (166.0) | 65% |
| 57 | +0.25% Vanlube 1202 + 0.75% Vanlube RD-HT (1:3) | 168.5 | (133.3) | 26% |
| 58 | +0.75% Vanlube 1202 + 0.25% Vanlube RD-HT (3:1) | 318.5 | (188.6) | 69% |

Conclusion: For the treat level of 1.0%, in the Group II base oil with OSP (4:1), Vanlube 1202 are AO synergistic with both Vanlube RD and Vanlube RD-HT from the ratio of 1:3 to 3:1

TABLE 8

PDSC oxidation induction time in Oil-soluble PAG base oil

| | | PDSC oxidation induction time, min, 160° C. | | |
|---|---|---|---|---|
| | Base Oil: Ucon OSP320 | 0 | | |
| 59 | +1.0% Naugalube APAN | 120.7 | | |
| 60 | +1.0% Vanlube RD | 22.5 | | |
| | | Actual | Expected | Improved |
| 61 | +0.5% Naugalube APAN + 0.5% Vanlube RD | 140.3 | (71.6) | 96% |
| 62 | +0.25% Naugalube APAN + 0.75% Vanlube RD | 100.6 | (47.1) | 114% |
| 63 | +0.75% Naugalube APAN + 0.25% Vanlube RD | 117.1 | (96.2) | 22% |

Conclusion: For the treat level of 1.0%, in OSP base oil, Naugalube APAN and Vanlube RD are AO synergistic from the ratio of 1:3 to 3:1 with the strongest synergy at 1:1 or less.

TABLE 9

PDSC oxidation induction time in water-soluble PAG base oil

| | | PDSC oxidation induction time, min, 160° C. | | |
|---|---|---|---|---|
| | Base Oil: Emkarox VG330W | 0 | | |
| 64 | +1.0% Naugalube APAN | 126.8 | | |
| 65 | +1.0% Vanlube RD | 17.5 | | |
| | | Actual | Expected | Improved |
| 66 | +0.5% Naugalube APAN + 0.5% Vanlube RD | 95.2 | (72.2) | 32% |

Conclusion: For the treat level of 1.0%, in water-soluble PAG base oil, Naugalube APAN and Vanlube RD are AO synergistic.

TABLE 10

PDSC oxidation induction time in water and oil-soluble PAG base oil

| | | PDSC oxidation induction time, min, 160° C. | | |
|---|---|---|---|---|
| | Base Oil: Emkarox VG380 | 0 | | |
| 67 | +1.0% Vanlube 1202 | 135.3 | | |
| 68 | +1.0% Vanlube RD | 20.8 | | |
| | | Actual | Expected | Improved |
| 69 | +0.5% Vanlube 1202 + 0.5% Vanlube RD | 122.6 | (78.1) | 57% |

Conclusion: For the treat level of 1.0%, in water and oil-soluble PAG base oil, Naugalube APAN and Vanlube RD are AO synergistic.

What is claimed is:

1. A lubricant composition comprising a polyalkylene glycol lubricant base being present at 90% or more by weight of the total lubricant composition; and an additive at about 0.25-2.0% by weight of the total composition, the additive comprising (1) $C_8$ alkylated phenyl-α-naphthylamine; and (2) a mixture of 1,2-dihydro-2,2,4-trimethylquinoline dimers and trimers;

with the proviso that, (a) when the additive is present at about 0.25-1.0%, components (1) and (2) are present at a weight ratio from 1:1 to 3:1 , and (b) when the additive is present at about 1.0-2.0%, components (1) and (2) are present at a weight ratio from 1:3 to 1:1.

2. The lubricant composition of claim 1, wherein components (1) and (2) are present at a weight ratio of about 1:1.

3. The lubricant composition of claim 1, wherein the composition is substantially free of ester base oil.

4. The lubricant composition of claim 1, wherein the composition is substantially free of mineral or natural or non-PAG synthetic base oil.

5. The lubricant composition of claim 1, wherein the lubricant base consists essentially of polyalkylene glycol.

6. The lubricant composition of claim 1, wherein the lubricant base comprises at least 90% by weight polyalkylene glycol.

7. The lubricant composition of claim 1, wherein the additive is present at about 1%.

* * * * *